US011136678B2

(12) United States Patent
Surendranath et al.

(10) Patent No.: US 11,136,678 B2
(45) Date of Patent: Oct. 5, 2021

(54) ELECTROCHEMICAL OXIDATION OF ALIPHATIC AND AROMATIC COMPOUNDS

(71) Applicant: MASSACHUSETTS INSTITUTE OF TECHNOLOGY, Cambridge, MA (US)

(72) Inventors: Yogesh Surendranath, Cambridge, MA (US); Matthew E. O'Reilly, Brighton, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 115 days.

(21) Appl. No.: 16/324,765

(22) PCT Filed: Aug. 11, 2017

(86) PCT No.: PCT/US2017/046512

§ 371 (c)(1),
(2) Date: Feb. 11, 2019

(87) PCT Pub. No.: WO2018/031893

PCT Pub. Date: Feb. 15, 2018

(65) Prior Publication Data

US 2019/0186026 A1 Jun. 20, 2019

Related U.S. Application Data

(60) Provisional application No. 62/465,935, filed on Mar. 2, 2017, provisional application No. 62/373,558, filed on Aug. 11, 2016.

(51) Int. Cl.
*C25B 3/03* (2021.01)
*C25B 3/05* (2021.01)
(Continued)

(52) U.S. Cl.
CPC ..... *C25B 3/23* (2021.01); *C25B 9/19* (2021.01); *C25B 11/04* (2013.01); *C25B 11/051* (2021.01); *C25B 11/057* (2021.01); *C25B 11/091* (2021.01)

(58) Field of Classification Search
CPC .... C25B 3/02; C25B 3/03; C25B 3/05; C25B 3/23
(Continued)

(56) References Cited

U.S. PATENT DOCUMENTS 4,661,422 A * 4/1987 Marianowski ..... H01M 8/142 429/476
4,670,108 A 6/1987 Kreh et al.
(Continued)

FOREIGN PATENT DOCUMENTS

DE 102014007135 A1 * 11/2015 ..... G01N 27/4045

OTHER PUBLICATIONS

Mazzotti et al., "Palladium(III)—Catalyzed Fluorination of Arylboronic Acid Derivatives," Journal of the American Chemical Society (Sep. 25, 2013), vol. 135, No. 38, p. 14012-14015. (Year: 2013).*
(Continued)

*Primary Examiner* — Edna Wong
(74) *Attorney, Agent, or Firm* — Foley Hoag LLP; Dana M. Gordon; Alexander J. Chatterley

(57) ABSTRACT

Disclosed are methods for the electrochemical oxidation of a C—H bond in a compound to give a C—O bond or C—S bond. The oxidation of methane to methanol is described, as well as an electrochemical cell for performing the reaction.

20 Claims, 3 Drawing Sheets

(51) Int. Cl.

| | |
|---|---|
| ***C25B 3/23*** | (2021.01) |
| ***C25B 11/04*** | (2021.01) |
| ***C25B 9/19*** | (2021.01) |
| ***C25B 11/051*** | (2021.01) |
| ***C25B 11/057*** | (2021.01) |
| ***C25B 11/091*** | (2021.01) |

(58) Field of Classification Search
USPC ..... 205/444, 452, 455, 445
See application file for complete search history.

(56) References Cited

U.S. PATENT DOCUMENTS

| | | | |
|---|---|---|---|
| 2008/0011604 | A1 | 1/2008 | Stevens et al. |
| 2008/0249197 | A1 | 10/2008 | Bricker et al. |
| 2012/0273366 | A1 | 11/2012 | Magalhaes Mendes |

OTHER PUBLICATIONS

Frese, Jr, "Partial Electrochemical Oxidation of Methane Under Mild Conditions," Langmuir (Jan. 1991), vol. 7, No. 1, pp. 13-15. (Year: 1991).*

Tomat et al., "Electrochemical Oxidation of Aliphatic Hydrocarbons Promoted by Inorganic Radicals. I. OH Radicals," Journal of Applied Electrochemistry (Mar. 1985), vol. 15, No. 2), pp. 167-173. (Year: 1985).*

Louhichi et al., "Electrochemical Oxidation of Benzoic Acid Derivatives on Boron Doped Diamond: Voltammetric Study and Galvanostatic Electrolyses," Chemical Engineering & Technology: Industrial Chemistry-Plant Equipment-Process Engineering-Biotechnology (Aug. 2006), vol. 29, No. 8, pp. 944-950. (Year: 2006).*

International Search Report and Written Opinion for International Application No. PCT/US2017/046512 dated Jan. 4, 2018.

* cited by examiner

ELECTROCHEMICAL OXIDATION OF ALIPHATIC AND AROMATIC COMPOUNDS

RELATED APPLICATIONS

This application is the U.S. National Stage of PCT/US2017/046512, filed Aug. 11, 2017, which claims the benefit of priority to U.S. Provisional Patent Application Ser. Nos. 62/373,558, filed Aug. 11, 2016; and 62/465,935, filed Mar. 2, 2017.

BACKGROUND

While natural gas (NG) is a valuable fuel and chemical, it is difficult to transport and store. At remote oil fields a significant amount of stranded NG is flared. Current technologies amenable to portable gas-to-liquid devices are not economically viable due to either low yields or the cost and disposal of stoichiometric oxidants.

Methane comprises the largest component of natural gas (NG) and is an attractive low carbon fuel that has the potential drastically to reduce $CO_2$ emissions if utilized broadly. While NG currently provides approximately 25% of the world's energy, annually about 150 billion cubic meters of NG extruded at oil drilling sites is flared without recuperating any economic or energetic value. One alternative to burning this "stranded gas" is transporting NG via pipelines to storage facilities, but this approach is economically prohibitive from remote areas, such as the Bakken Oil Fields. Converting NG to liquid fuel, such as methanol, could enable more efficient utilization of the resource, but the current industrial method for upgrading methane to methanol via syn gas is an energy and capital intensive process, making it difficult if not impossible to employ at remote locations.

A portable device for the direct conversion of methane to methanol operating at <200° C. and 500 psig methane would allow for more efficient utilization of this resource. However, the selective aerobic oxidation of methane to methanol has been a longstanding challenge in electrochemistry because the C—H bonds of methanol are more reactive than those of methane, making methanol susceptible to over-oxidation.

High-valent late transition metal elements in concentrated sulfuric acid, trifluoroacetic acid, and water have emerged as frontrunners for the controlled oxidation of methane into methanol derivatives below 250° C. with high selectivity. Yet, these systems currently face at least two large hurdles impeding their commercialization: (1) achieving high methane conversion and (2) finding inexpensive chemical oxidants that can be readily regenerated in air. Any approach in which a chemical oxidant must be transported to remote locations and disposed of after use is economically prohibitive given the scale of methane production.

There exists a need for an economically viable oxidation system that can convert aliphatic and aromatic compounds, such as methane, into easily transported products with efficient energy use in the process. The electrochemical cell and oxidation methods described herein provide an effective solution to harnessing the energy present in these compounds.

SUMMARY

Provided herein are methods of oxidizing a carbon-hydrogen bond of a compound, comprising:

a) in an electrochemical cell comprising an anode and a cathode, combining a medium, the compound, and a transition metal catalyst, thereby forming a mixture; wherein the compound is an aliphatic compound or an aromatic compound, and the catalyst comprises a transition metal atom or ion; and b) applying an electrical current between the anode and the cathode, thereby forming a product in which the carbon-hydrogen bond has been converted to a carbon-oxygen bond or a carbon-sulfur bond;

wherein the cathode is in ionic communication with the mixture; and the anode is in contact with the mixture.

Also provided herein are methods of preparing methanol, comprising:

a) in an electrochemical cell comprising an anode and a cathode, combining a medium, methane, an oxidant, and a transition metal catalyst, thereby forming a mixture; and b) applying an electrical current between the anode and the cathode, thereby oxidizing methane to methanol;

wherein the anode comprises fluorine-doped tin oxide, indium-doped tin oxide, boron-doped diamond, gold foil or palladium foil; the medium is $H_2SO_4$, $CH_3SO_3H$, $CF_3CO_2H$, HF, HCl, HBr, HI or $H_2O$, or any mixture thereof; the oxidant is $O_2$, $O_3$, $H_2O_2$, $Cl_2$, $Br_2$, $I_2$, $SO_3$, $H_2SO_4$, $(IO_4)^{-2}$, $(IO_3)^{-2}$, $(IO_4)^{-2}$, $(IO_3)^{-2}$, or $(C_6F_5)I(OC(O)CF_3)_2$; the transition metal catalyst comprises gold or palladium; the cathode comprises platinum; the cathode is in ionic communication with the mixture; and the anode is in contact with the mixture.

Also provided herein are electrochemical cells, comprising a stainless steel vessel; a mixture of methane, an oxidant, a medium, and a transition metal catalyst contained in the vessel; an anode, and a cathode;

wherein the anode comprises fluorine-doped tin oxide or boron-doped diamond; the oxidant is $O_2$; the medium is $H_2SO_4$; the transition metal catalyst comprises gold or palladium; the cathode comprises platinum; the cathode is in ionic communication with the mixture; and the anode is in contact with the mixture.

DETAILED DESCRIPTION

Overview

A portable inexpensive device for the direct conversion of methane to methanol operating at <200° C. and <500 psi is highly sought-after technology to employ at remote oil fields to recuperate economic and energetic value from natural gas expelled during oil drilling operations. Current limitations for low temperature methane-to-methanol technologies employing molecular catalysts {$PdSO_4$, (bpym)$PtCl_2$, $HgSO_4$, $Au_2(SO_4)_3$} are the strong oxidants {e.g. $H_2SO_4$, $(IO_4)^{-2}$, $(IO_3)^{-2}$, and $(C_6F_5)I(OC(O)CF_3)_2$} that are not easily regenerated in air. The associated cost of using stoichiometric metal/halogenated oxidants including transportation and disposal prevents commercial application.

Figure 1:
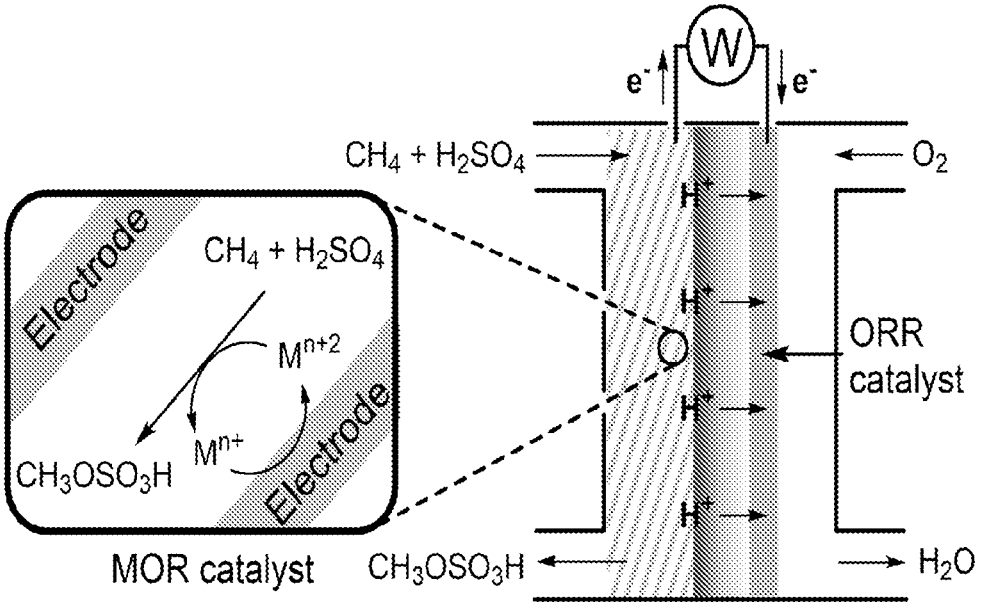
FIG. 1 depicts a continuous flow electrochemical cell having separate chambers for the oxidant reduction reaction (ORR) and methane oxidation reaction (MOR) processes. The conversion of methane to methanol is described.

Disclosed herein is an electrochemical cell that can electrochemically convert methane to methanol, which allows the replacement of expensive stoichiometric oxidants with $O_2$ via an external power generator or in a separated oxygen reduction catalyst (See FIG. 1). In some embodiments, the conversion produces >1 M $CH_3OH$ in concentrated sulfuric acid with >80% faradaic efficiency. The reaction proceeds by electro-oxidation of a Pd(II) catalyst to generate a $Pd_2^{6+}$ species. Moreover, the electrochemically generated $Pd_2^{6+}$ mediates methane oxidation with a remarkably low activation barrier of 26 kcal/mol, permitting methane conversion at temperature as low as 80° C.

In some embodiments, the electrochemical methane-to-methanol method also produces methyl bisulfate when conducted in sulfuric acid. Also disclosed herein is an electrochemical cell and catalysts capable of mediating electrochemical methane oxidation to methanol and methyl bisulfate in >95% sulfuric acid.

Given the conversion efficiency and lower cost operating conditions, such as relatively lower temperature and pressures than previously known reactions, the disclosed process can be utilized for the activation of C—H bonds on a wide variety of substrates, such as alkanes, heteroalkanes, cycloalkanes, and heterocycles. In an acidic medium, transition catalysts use $O_2$ to oxidize the C—H bond of the substrate to either a C—O bond or a C—S bond. The specificity of the disclosed oxidation methods allows for selective activation of a C—H bond on a substrate that has other heteroatoms, such as nitrogen, oxygen, and sulfur, separated by only 2 or more carbon atoms. Thus, the potential to capture the energy in natural gas currently flared in oil fields finds broad applications in the electrochemical oxidation of larger substrates than methane.

Provided herein are methods of oxidizing a carbon-hydrogen bond of a compound, comprising:

a) in an electrochemical cell comprising an anode and a cathode, combining a medium, the compound, and a transition metal atom or ion catalyst, thereby forming a mixture; wherein the compound is an aliphatic compound or an aromatic compound, and the catalyst comprises a transition metal atom or ion; and b) applying an electrical current between the anode and the cathode, thereby forming a product in which the carbon-hydrogen bond has been converted to a carbon-oxygen bond or a carbon-sulfur bond;

wherein the cathode is in ionic communication with the mixture; and the anode is in contact with the mixture.

In certain embodiments, the cathode is in fluid communication with the mixture; and the anode is in contact with the mixture.

In certain embodiments, the cathode is in contact with the mixture; and the anode is in contact with the mixture.

In certain embodiments, the catalyst is the palladium(III) catalytic agent prepared according to any one of the processes described below.

Disclosed herein are methods of preparing methanol, comprising:

a) in an electrochemical cell comprising an anode and a cathode, combining a medium, methane, an oxidant, and a transition metal catalyst, thereby forming a mixture; and b) applying an electrical current between the anode and the cathode, thereby oxidizing methane to methanol;

wherein the anode comprises fluorine-doped tin oxide, indium-doped tin oxide boron-doped diamond, gold foil or palladium foil; the oxidant is $O_2$, $O_3$, $H_2O_2$, $Cl_2$, $Br_2$, $I_2$, $SO_3$, $H_2SO_4$, $(IO_4)^{-2}$, $(IO_3)^{-2}$, $(IO_4)^{-2}$, $(IO_3)^{-2}$, or $(C_6F_5)I(OC(O)CF_3)_2$; the medium is $H_2SO_4$, $CH_3SO_3H$, $CF_3CO_2H$, HF, HCl, HBr, HI, or $H_2O$, or any mixture thereof; the transition metal catalyst comprises gold or palladium; the cathode comprises platinum; the cathode is in ionic communication with the mixture; and the anode is in contact with the mixture.

In certain embodiments, the cathode is in fluid communication with the mixture; and the anode is in contact with the mixture.

In certain embodiments, the cathode is in contact with the mixture; and the anode is in contact with the mixture.

In certain embodiments, the transition metal catalyst is the palladium(III) catalytic agent prepared according to any one of the processes described below.

Disclosed herein is an electrochemical cell, comprising a stainless steel vessel; a mixture of methane, an oxidant, a medium, and a transition metal catalyst contained in the vessel; an anode, and a cathode;

wherein the anode comprises fluorine-doped tin oxide or boron-doped diamond; the oxidant is $O_2$, $O_3$, $H_2O_2$, $C_{12}$, $Br_2$, $I_2$, $SO_3$, $H_2SO_4$, $(IO_4)^{-2}$, $(IO_3)^{-2}$, $(IO_4)^{-2}$, $(IO_3)^{-2}$, or $(C_6F_5)I(OC(O)CF_3)_2$; the medium is $H_2SO_4$; the transition metal catalyst comprises gold or palladium; the cathode comprises platinum; the cathode is in ionic communication with the mixture; and the anode is in contact with the mixture.

In certain embodiments, the cathode is in fluid communication with the mixture; and the anode is in contact with the mixture.

In certain embodiments, the cathode is in contact with the mixture; and the anode is in contact with the mixture.

In certain embodiments, the transition metal catalyst is the palladium(III) catalytic agent prepared according to any one of the processes described below.

Definitions

Unless defined otherwise, all technical and scientific terms used herein have the meaning commonly understood by a person skilled in the art of the present disclosure. The following references provide one of skill with a general definition of many of the terms used in this disclosure: Singleton et al., Dictionary of Microbiology and Molecular Biology (2nd ed. 1994); The Cambridge Dictionary of Science and Technology (Walker ed., 1988); The Glossary of Genetics, 5th Ed., R. Rieger et al. (eds.), Springer Verlag (1991); and Hale & Marham, The Harper Collins Dictionary of Biology (1991). As used herein, the following terms have the meanings ascribed to them below, unless specified otherwise.

The transitional term "comprising", which is synonymous with "including," "containing," or "characterized by," is inclusive or open-ended, and does not exclude additional, unrecited elements or method steps. The transitional phrase "consisting of" excludes any element, step, or ingredient not specified in the claim. The transitional phrase "consisting essentially of" limits the scope of a claim to the specified materials or steps and those that do not materially affect the basic and novel characteristic(s) of the claimed invention.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50.

Unless specifically stated or obvious from context, as used herein, the term "or" is understood to be inclusive; any species linked by "or" also includes any mixture thereof. Unless specifically stated or obvious from context, as used herein, the terms "a", "an", and "the" are understood to be singular or plural.

Unless specifically stated or obvious from context, as used herein, the term "about" is understood as within a range of normal tolerance in the art, for example within 2 standard deviations of the mean. About can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used herein, the term "alkyl", by itself or as part of another substituent means, unless otherwise stated, a branched or unbranched saturated hydrocarbon group. The term "alkane" means an alkyl group with a terminal hydrogen atom, for example, methyl is an alkyl group and methane is an alkane. The term "n-alkyl" refers to an unbranched alkyl group. The term "$C_x$-$C_y$ alkyl" refers to an alkyl group having between x and y carbon atoms, inclusively, in the branched or unbranched hydrocarbon group. By way of illustration, but without limitation, the term "$C_1$-$C_8$ alkyl" refers to a straight chain or branched hydrocarbon moiety having from 1, 2, 3, 4, 5, 6, 7, or 8 carbon atoms. "$C_1$-$C_6$" refers to a straight chain or branched hydrocarbon moiety having from 1, 2, 3, 4, 5, or 6 carbon atoms. "$C_1$-$C_4$ alkyl" refers to a straight chain or branched hydrocarbon moiety having from 1, 2, 3, or 4 carbon atoms, including methyl, ethyl, n-propyl, iso-propyl, n-butyl, iso-butyl, sec-butyl, and tert-butyl. The term "$C_1$-$C_4$ n-alkyl" refers to straight chain hydrocarbon moieties that have 1, 2, 3, or 4 carbon atoms including methyl, ethyl, n-propyl, and n-butyl.

As used herein, the term "alkenyl" by itself or as part of another substituent means, unless otherwise stated, a straight or branched hydrocarbon chain radical group consisting solely of carbon and hydrogen atoms, containing at least one double bond, and having from two to ten carbon atoms (i.e., $C_{2-10}$ alkenyl). The term "alkene" means an alkenyl group with a terminal hydrogen atom, for example, propenyl is an alkenyl group and propene is an alkene.

Whenever it appears herein, a numerical range such as "2 to 10" refers to each integer in the given range; e.g., "2 to 10 carbon atoms" means that the alkenyl group can consist of 2 carbon atoms, 3 carbon atoms, etc., up to and including 10 carbon atoms. In certain embodiments, an alkenyl comprises two to eight carbon atoms. In other embodiments, an alkenyl comprises two to six carbon atoms (e.g., $C_{2-6}$ alkenyl). The alkenyl is attached to the parent molecular structure by a single bond, for example, ethenyl (i.e., vinyl), prop-1-enyl (i.e., allyl), but-1-enyl, pent-1-enyl, penta-1,4-dienyl, and the like. The one or more carbon-carbon double bonds can be internal (such as in 2-butenyl) or terminal (such as in 1-butenyl). Examples of $C_{2-4}$ alkenyl groups include ethenyl ($C_2$), 1-propenyl ($C_3$), 2-propenyl ($C_3$), 1-butenyl ($C_4$), 2-butenyl ($C_4$), 2-methylprop-2-enyl ($C_4$), butadienyl ($C_4$) and the like. Examples of $C_{2-6}$ alkenyl groups include the aforementioned $C_{2-4}$ alkenyl groups as well as pentenyl ($C_5$), pentadienyl ($C_5$), hexenyl ($C_6$), 2,3-dimethyl-2-butenyl ($C_6$) and the like, and the higher homologs and isomers. A non-limiting functional group representing an alkene is exemplified by —$CH_2$—CH=$CH_2$.

As used herein, the term "alkoxy" means a linear or branched, saturated, monovalent group of formula (alkyl)-O—, in which the term "alkyl" is as defined herein. In some embodiments, the alkoxy group is a "$C_1$-$C_6$-alkoxy-", such as a methoxy, ethoxy, n-propoxy, iso-propoxy, n-butoxy, iso-butoxy, tert-butoxy, sec-butoxy, pentyloxy, iso-pentyloxy or n-hexyloxy group, or an isomer thereof.

As used herein, the term"aliphatic compound" means a saturated or partially unsaturated linear, branched, acyclic or cyclic compound that can be a hydrocarbon having only carbon and hydrogen atoms, or a compound where one or more carbon atoms are replaced by a heteroatom selected from nitrogen, oxygen and sulphur. In some embodiments, 1, 2, 3, or 4 carbon atoms are replaced by a heteroatom. Exemplary aliphatic compounds include alkanes, heteroalkanes, alkenes, cycloalkanes, and heterocycles as defined herein.

As used herein, the term "aromatic compound" means a mono-, di-, tri- or polycyclic ring system where at least one ring has a conjugated pi electron system.

Exemplary aromatic compounds include arenes and heteroarenes as defined herein. The ring system may be a hydrocarbon having only carbon and hydrogen atoms or a compound where one or more carbon atoms are replaced by a heteroatom selected from nitrogen, oxygen and sulphur. In some embodiments, 1, 2, 3, or 4 carbon atoms are replaced by a heteroatom. In a polycyclic ring system, only one ring needs to have a conjugated pi electron system, such that rings like tetrahydronaphthalene and naphthalene are both aromatic compounds.

As used herein, the term "aryl" means a radical with 6 to 14 ring atoms (e.g., $C_{6-14}$ aryl) that is a monocyclic or polycyclic (e.g., bicyclic or tricyclic) and has at least one ring having a conjugated pi electron system (e.g., having 6, 10 or 14 it electrons shared in a cyclic array). The term "arene" means an aryl group with a terminal hydrogen atom, for example, phenyl is an aryl group and benzene is an arene.

In some embodiments, the aryl is a $C_{6-10}$ aryl group. Whenever it appears herein, a numerical range such as "6 to 14 aryl" refers to each integer in the given range; e.g., "6 to 14 ring atoms" means that the aryl group can consist of 6 ring atoms, 7 ring atoms, etc., up to and including 14 ring atoms. The term includes monocyclic or fused-ring polycyclic (i.e., rings which share adjacent pairs of ring atoms) groups. In a multi-ring group, only one ring is required to be aromatic, so groups such as indanyl are encompassed by the aryl definition.

As used herein, the term "cycloalkyl" means a saturated mono- or bicyclic hydrocarbon ring which contains 3, 4, 5, 6, 7, 8, 9 or 10 carbon atoms ("$C_3$-$C_{10}$-cycloalkyl-"). The term "cycloalkane" means an cycloalkyl group with a terminal hydrogen atom, for example, cyclopropyl is a cycloalkyl group and cyclopropane is a cycloalkane. A cycloalkyl group may be optionally substituted as defined at the respective part wherein such term is used.

As used herein, the term "heteroalkyl", by itself or as part of another substituent means, unless otherwise stated, a branched or unbranched saturated group that consists of carbon atoms and at least one heteroatom. A heteroalkyl can have 1, 2, 3, or 4 carbon atoms replaced by a heteroatom selected from nitrogen, oxygen and sulfur. The term "heteroalkane" means a heteroalkyl group with a terminal hydrogen atom, for example, methoxymethyl is an alkyl group and methoxymethane is a heteroalkane.

As used herein, the term "heterocyclyl", by itself or as part of another substituent means, unless otherwise stated, an unsubstituted or substituted, stable, mono-, di, tri, or polycyclic heterocyclic ring system that consists of carbon atoms and at least one heteroatom. The term "heterocycle" means a heterocyclyl group with a terminal hydrogen atom, for example, furanyl is a heterocyclyl group and furan is a heterocycle.

A heterocyclyl refers to any 3- to 18-membered non-aromatic radical monocyclic or polycyclic moiety comprising at least one heteroatom selected from nitrogen, oxygen, phosphorous and sulfur. In some aspects, the heteroatom(s) are chosen from N, O, and S. A heterocyclyl group can be a monocyclic, bicyclic, tricyclic or tetracyclic ring system, wherein the polycyclic ring systems can be a fused, bridged or spiro ring system. Heterocyclyl polycyclic ring systems can include one or more heteroatoms in one or both rings. A heterocyclyl group can be saturated or partially unsaturated. Partially unsaturated heterocyclyl groups can be termed "heterocycloalkenyl" if the heterocyclyl contains at least one double bond, or "heterocycloalkynyl" if the heterocyclyl contains at least one triple bond. Whenever it appears herein, a numerical range such as "5 to 18" refers to each integer in the given range; e.g., "5 to 18 ring atoms" means that the heterocyclyl group can consist of 5 ring atoms, 6 ring atoms, etc., up to and including 18 ring atoms.

An N-containing heterocyclyl moiety refers to an non-aromatic group in which at least one of the ring atoms is a nitrogen atom. The heteroatom(s) in the heterocyclyl radical can be optionally oxidized. One or more nitrogen atoms, if present, can be optionally quaternized. Heterocyclyl also includes ring systems substituted with one or more nitrogen oxide (—O—) substituents, such as piperidinyl N-oxides. The heterocyclyl is attached to the parent molecular structure through any atom of any of the ring(s).

"Heterocyclyl" also includes ring systems wherein the heterocyclyl ring, as defined above, is fused with one or more carbocyclyl groups wherein the point of attachment is either on the carbocyclyl or heterocyclyl ring, or ring systems wherein the heterocyclyl ring, as defined above, is fused with one or more aryl or heteroaryl groups, wherein the point of attachment to the parent molecular structure is on the heterocyclyl ring.

As used herein, the term "heteroaryl" means a 5-18 membered mono- or polycyclic (e.g., bicyclic or tricyclic) having a conjugated it-ring system (e.g., having 6, 10 or 14π electrons shared in a cyclic array) having ring carbon atoms and 1-6 ring heteroatoms provided in the aromatic ring system, wherein each heteroatom is independently selected from nitrogen, oxygen, and sulfur ("5-18 membered heteroaryl"). The term "heteroarene" means a heteroaryl group with a terminal hydrogen atom, for example, pyridinyl is a heteroaryl group and pyridine is a heterocycle.

Heteroaryl polycyclic ring systems can include one or more heteroatoms in one or both rings. Whenever it appears herein, a numerical range such as "5 to 18" refers to each integer in the given range; e.g., "5 to 18 ring atoms" means that the heteroaryl group can consist of 5 ring atoms, 6 ring atoms, etc., up to and including 18 ring atoms. In some instances, a heteroaryl can have 5 to 14 ring atoms.

For example, an N-containing "heteroaryl" moiety refers to an aromatic group in which at least one of the skeletal atoms of the ring is a nitrogen atom. One or more heteroatom(s) in the heteroaryl radical can be optionally oxidized. One or more nitrogen atoms, if present, can also be optionally quaternized. Heteroaryl also includes ring systems substituted with one or more nitrogen oxide (—O—) substituents, such as pyridinyl N-oxides. The heteroaryl is attached to the parent molecular structure through any atom of the ring(s).

"Heteroaryl" also includes ring systems wherein the heteroaryl ring, as defined above, is fused with one or more aryl groups wherein the point of attachment to the parent molecular structure is either on the aryl or on the heteroaryl ring, or wherein the heteroaryl ring, as defined above, is fused with one or more cycloalkyl or heterocyclyl groups wherein the point of attachment to the parent molecular structure is on the heteroaryl ring. For polycyclic heteroaryl groups wherein one ring does not contain a heteroatom (e.g., indolyl, quinolinyl, carbazolyl and the like), the point of attachment to the parent molecular structure can be on either ring, i.e., either the ring bearing a heteroatom (e.g., 2-indolyl) or the ring that does not contain a heteroatom (e.g., 5-indolyl).

The terms "substituted" or "substitution" mean that at least one hydrogen present on a group atom (e.g., a carbon or nitrogen atom) is replaced with a permissible substituent, e.g., a substituent which upon substitution for the hydrogen results in a stable compound, e.g., a compound which does not spontaneously undergo transformation such as by rearrangement, cyclization, elimination, or other reaction. Unless otherwise indicated, a "substituted" group can have a substituent at one or more substitutable positions of the group, and when more than one position in any given structure is substituted, the substituent is either the same or different at each position. Exemplary substituents include, but are not limited to, acyl, alkyl, alkenyl, alkynyl, alkoxy, alkylaryl, cycloalkyl, aralkyl, aryl, aryloxy, amino, amido, amidino, imino, azide, carbonate, carbamate, carbonyl, heteroalkyl, heteroaryl, heteroarylalkyl, heterocyclyl, hydroxy, cyano, halo, haloalkoxy, haloalkyl, ester, ether, mercapto, thio, alkylthio, arylthio, thiocarbonyl, nitro, oxo, phosphate, phosphonate, phosphinate, silyl, sulfinyl, sulfonyl, sulfonamidyl, sulfoxyl, sulfonate, and urea.

As used herein, the terms "sulfide", "thiol", "mercapto", and "mercaptan" can also each refer to the group —$R^b$SH. The term "disulfide" refers to an —S—S— single bond between two sulfur atoms.

As used herein, "sulfanyl", "sulfide", and "thio" each refer to the radical —S—$R^b$, wherein Rb is selected from alkyl, alkenyl, alkynyl, haloalkyl, heteroalkyl (bonded through a chain carbon), cycloalkyl, cycloalkylalkyl, aryl, aralkyl, heterocyclyl (bonded through a ring carbon), heterocyclylalkyl, heteroaryl (bonded through a ring carbon) or heteroarylalkyl, unless stated otherwise in the specification. For instance, an "alkylthio" refers to the "alkyl-S—" radical, and "arylthio" refers to the "aryl-S—" radical, each of which are bound to the parent molecular group through the S atom.

As used herein, "sulfinyl" or "sulfoxide" refers to the —S(O)—$R^b$ radical, wherein for "sulfinyl", $R^b$ is H and for "sulfoxide", $R^b$ is selected from alkyl, alkenyl, alkynyl, haloalkyl, heteroalkyl (bonded through a chain carbon), cycloalkyl, cycloalkylalkyl, aryl, aralkyl, heterocyclylalkyl (bonded through a ring carbon), heteroaryl (bonded through a ring carbon) or heteroarylalkyl.

As used herein, "sulfonyl" or "sulfone" refers to the —S(═O)$_2$—$R^b$ radical, wherein $R^b$ is selected from hydrogen, alkyl, alkenyl, alkynyl, haloalkyl, heteroalkyl (bonded through a chain carbon), cycloalkyl, cycloalkylalkyl, aryl, aralkyl, heterocycloalkyl (bonded through a ring carbon), heterocyclylalkyl, heteroaryl (bonded through a ring carbon) or heteroarylalkyl.

As used herein, "sulfoxyl" or "sulfoxide" refers to a —S(═O)$_2$OH radical.

As used herein, "sulfonate" refers to a —S(═O)$_2$—O$R^b$ radical, wherein $R^b$ is selected from alkyl, alkenyl, alkynyl, haloalkyl, heteroalkyl (bonded through a chain carbon), cycloalkyl, cycloalkylalkyl, aryl, aralkyl, heterocycloalkyl (bonded through a ring carbon), heterocyclylalkyl, heteroaryl (bonded through a ring carbon) or heteroarylalkyl.

As used herein, "sulfate" refers to the $S(=O)_2(O^-)_2$ anion.

As used herein, the term "$H_2SO_4$" or "sulfuric acid" refers to any concentration of sulfuric acid, which can be in aqueous solution. ">95% $H_2SO_4$ refers to fuming sulfuric acid which is composed of $SO_3$ gas dissolved in water.

As used herein, a "salt" refers to an inert salt which, in some embodiments, is added to the reaction medium. A salt can be an acid addition salt derived from an inorganic acid, such as hydrochloric acid, hydrobromic acid, sulfuric acid, nitric acid, phosphoric acid, metaphosphoric acid, and the like. Another type of salt is one where an acidic proton is replaced by a metal ion, e.g., an alkali metal ion (e.g. lithium, sodium, potassium), an alkaline earth ion (e.g. magnesium, or calcium), or an aluminum ion. Inorganic basic salts include aluminum hydroxide, calcium hydroxide, potassium hydroxide, sodium carbonate, sodium hydroxide, and the like. Inert salts can have as their cation an element from group 1 or 2 of the periodic table of the elements and an anion comprising an element from the groups 15-17 of the periodic table of the elements. Such cations include $Li^+$, $Na^+$, $K^+$, $Rb^+$, $Cs^+$, $Mg^{2+}$, and $Ca^{2+}$. Such anions include $CO_3^{2-}$, $HCO_3^-$, $PO_4^{3-}$, $HPO_4^{2-}$, $H_2PO_4^-$, $NO_2^-$, $NO_3^-$, $SO_4^{2-}$, $HSO_4^-$, $F^-$, $Cl^-$, $Br^-$ and $I^-$, $CH_3COO^-$, and $CF_3COO^-$. Exemplary salts include $Li_2CO_3$, $K_2HPO_4$, $MgCl_2$, NaCl, etc.

As used herein, the term "transition metal" refers to elements found in groups 3 through 12 of the periodic table of the elements. Transition metals include, but are not limited to, palladium, cobalt, mercury, gold, copper, iridium, rhodium, ruthenium, manganese, vanadium, europium, osmium, and platinum. Used as a catalyst, the transition metal may be in cationic form having an oxidation state from neutral (0), $1^+$ (I), $2^+$ (II), $3^+$ (III), $4^+$ (IV), $5^+$ (V), to $6^+$ (VI). Exemplary catalyst ions include Pd(II), Au(II) and Au(III).

As used herein, the term "main group element" refers to elements found in groups 13 through 17 of the periodic table of the elements. Main group elements include, but are not limited to, lead, thallium, iodine and chlorine. Used as a catalyst, the main group elements may be in cationic form having an oxidation state from neutral (0), $1^+$ (I), $2^+$ (II), $3^+$ (III), to $4^+$ (IV). Exemplary catalyst ions include Pb(IV) and Tl(III).

The recitation of a listing of chemical groups in any definition of a variable herein includes definitions of that variable as any single group or combination of listed groups. The recitation of an embodiment for a variable or aspect herein includes that embodiment as any single embodiment or in combination with any other embodiments or portions thereof.

Compounds

In certain embodiments, the compound is an aliphatic compound selected from the group consisting of an alkane, a heteroalkane, a cycloalkane, and a heterocycle. For example, the aliphatic compound can be a straight or branched $C_{1-15}$ alkane or straight or branched $C_{1-8}$ alkane. In certain embodiments, the aliphatic compound is selected from the group consisting of methane, ethane, propane, isopropane, butane, isobutane, pentane, isopentane, neopentane, hexane, heptane, and octane. In one embodiment, the aliphatic compound is methane.

In certain embodiments, the aliphatic compound is a heteroalkane; and the heteroalkane is an alkane in which 1 to 3 carbon atoms are each replaced by an atom independently selected from the group consisting of N, O, and S. In certain embodiments, the compound is an aliphatic compound represented by formula I:

I

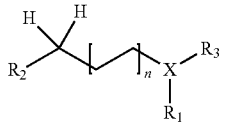

wherein

X is selected from the group consisting of CH, O, N, and S;

if X is CH, then $R_1$ is selected from the group consisting of alkoxy, hydroxyl, halo, —C(O)-alkyl, and —C(O)OH;

if X is N, then $R_1$ is hydrogen or alkyl;

if X is O or S, then $R_1$ is absent;

$R_2$ is selected from the group consisting of hydrogen, alkyl, and aryl;

$R_3$ is alkyl or aryl; and n is 1, 2, 3, 4, or 5.

In certain embodiments, the aliphatic compound is a $C_3$-$C_{15}$ cycloalkane; and the cycloalkane is monocyclic, bicyclic, tricyclic, or polycyclic. In certain embodiments, the cycloalkane is selected from the group consisting of cyclopropane, cyclobutane, cyclopentane, cyclohexane, decalin, and adamantane.

In certain embodiments, the aliphatic compound is a heterocycle; and the heterocycle is a cycloalkane in which 1 to 3 carbon atoms are each replaced by an atom independently selected from the group consisting of N, O, and S. In further embodiments, the heterocycle is selected from the group consisting of tetrahydrofuran, dihydrofuran, tetrahydrothiophene, dihydrothiophene, pyrrolidine, dihydropyrrole, pyrrole-2,5-dione, dioxolane, oxathiolane, thiazolidine, dithiolane, piperidine, morpholine, tetrahydropyran, dihydropyran, and dihydropyridine.

In certain embodiments, the compound is an aromatic compound; and the aromatic compound is an arene or heteroarene. In certain embodiments, the aromatic compound is a $C_6$-$C_{18}$ arene; and the arene is monocyclic, bicyclic, or tricyclic. In some embodiments, the arene is selected from the group consisting of benzene, toluene, styrene, naphthalene, 1,1'-biphenyl, pyrene, indene, and terphenyl.

In certain embodiments, the aromatic compound is a heteroarene; and the heteroarene is an arene in which 1 to 4 carbon atoms are each replaced by an atom independently selected from the group consisting of N, O, and S. In some embodiments, the heteroarene is selected from the group consisting of thiene, furan, pyrrole, oxazole, thiazole, imidazole, pyrazole, isoxazole, isothiazole, oxadiazole, triazole, thiadiazole, tetrazole, pyridine, pyridazine, pyrimidine, pyrazine, triazine, benzofuran, benzothiene, benzoxazole, benzisoxazole, benzimidazole, benzothiazole, benzotriazole, indazole, indole, isoindole, quinoline, quinazoline, isoquinoline, cinnoline, phthalazine, quinoxaline, indolizine, purine, pteridine, carbazole, acridine, and phenazinyl.

Oxidant

In certain embodiments, an oxidant is added to the mixture, such as $O_2$. Other oxidants that can be used in the disclosed methods include, but are not limited to, $O_2$, $O_3$, $H_2O_2$, $Cl_2$, $Br_2$, $I_2$, $SO_3$, $H_2SO_4$, $(IO_4)^{-2}$, $(IO_3)^{-2}$, $(IO_4)^{-2}$, $(IO_3)^{-2}$, and $(C_6F_5)I(OC(O)CF_3)_2$.

Catalysts

Figure 3:
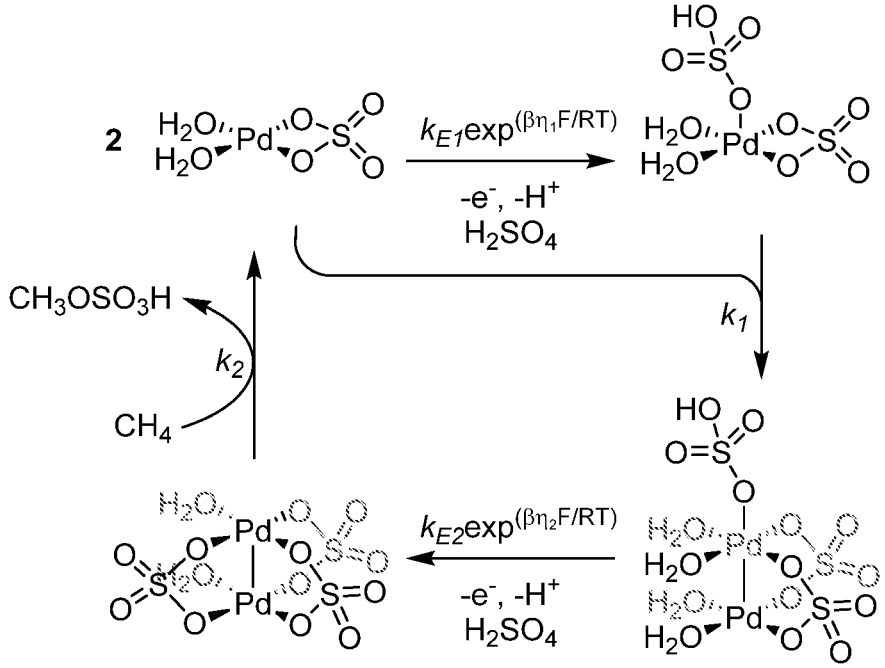
FIG. 3 depicts a putative mechanism for the conversion of methane to methanol using a $PdSO_4$ catalyst in $H_2SO_4$ in the presence of $O_2$.
Figure 5:
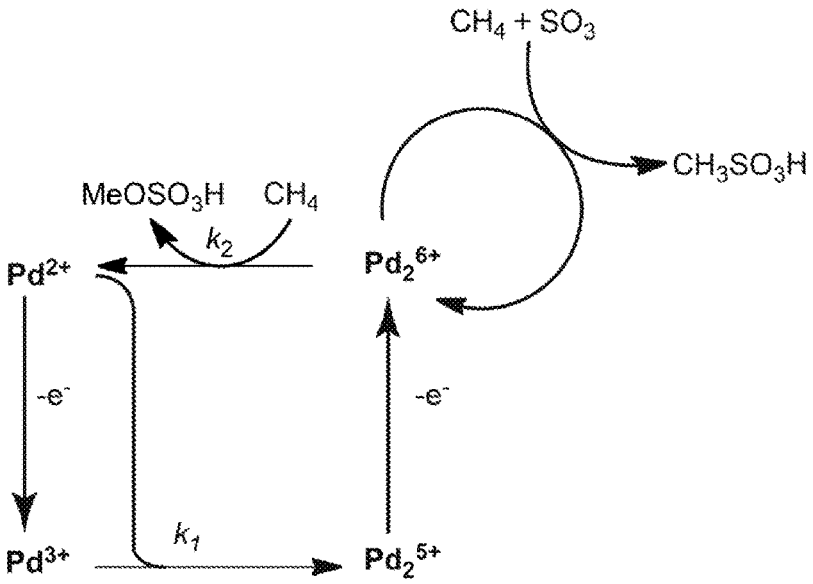
FIG. 5 depicts a putative mechanism for the conversion of methane to $MeSO_3H$ and $MeOSO_3H$ using a $Pd^{3+}$ catalyst species.

In certain embodiments, the catalyst comprises a transition metal atom or ion selected from the group consisting of palladium(0/II/III/IV), cobalt(II/III), lead(II/IV), mercury(I/II), gold(0/I/III), thallium(I/III), copper (I/II/III), iridium(I/II/III), rhodium(I/II/III), manganese, vanadium(IV), europium (II/III), osmium(VIII), ruthenium(IV), and platinum (II/IV). In a preferred embodiment, the catalyst comprises palladium(III) (see FIG. 5). The catalyst can comprise two palladium (III) atoms bonded to each other or bridged by a single atom. Without wishing to be bound by any particular theory, a catalytic intermediate in the oxidation of methane can be $Pd_2(SO_4H_x)_y(OH_n)_m$ (see FIG. 3) where x, y, n, and m can each independently range from 0-8. In some embodiments, x ranges from 0-2. In some embodiments y ranges from 1-4. In some embodiments, n is 1 or 2. In some embodiments, m is 1 or 2. In some embodiments, the catalytic intermediate is $Pd_2(SO_4)_3(OH_2)_2$.

In certain embodiments, the transition metal catalyst is a gold sulfate or a palladium sulfate, such as gold(III) sulfate, gold(II) sulfate, gold(I) sulfate, palladium(III) sulfate or palladium(II) sulfate. In some embodiments, the transition metal catalyst is gold(III) sulfate or gold(I) sulfate, formed by dissolving gold(0) in the medium, thereby forming gold (III) sulfate or gold(I) sulfate. In a preferred embodiment, the transition metal catalyst is palladium(II) sulfate.

Another aspect of the invention relates to a palladium(III) catalytic agent prepared by a process comprising the steps of:

(a) combining a palladium(II) salt and concentrated sulfuric acid in a vessel;

(b) placing the vessel in ionic communication with an electrochemical cell; and (c) applying an electric potential to the electrochemical cell.

In certain embodiments, the invention relates to the aforementioned palladium(III) catalytic agent, wherein the concentrated sulfuric acid is 98% sulfuric acid.

In certain embodiments, the invention relates to the aforementioned palladium(III) catalytic agent, wherein the concentrated sulfuric acid is fuming sulfuric acid.

In certain embodiments, the invention relates to the aforementioned palladium(III) catalytic agent, wherein the vessel is a glass vessel or a stainless steel vessel.

In certain embodiments, the invention relates to the aforementioned palladium(III) catalytic agent, wherein the palladium(II) salt is $Pd(SO_4)(OH_2)_2$.

In certain embodiments, the invention relates to the aforementioned palladium(III) catalytic agent, further comprising the step of applying heat to the electrochemical cell before or while the electrical potential is applied.

Medium

In certain embodiments, the medium is selected from the group consisting of methanesulfonic acid, phosphoric acid, hydrofluoric acid, hydrochloric acid, hydrobromic acid, hydroiodic acid, oxalic acid, benezenesulfonic acid, tosylic acid (4-toluenesulfonic acid), perchloric acid, nitric acid, acetic acid, >95% sulfuric acid, and mixtures of $SO_3$ and sulfuric acid. In some embodiments, the medium is $H_2SO_4$, $CH_3SO_3H$, $CF_3CO_2H$, HF, HCl, HBr, HI or $H_2O$, or any mixture thereof. In some embodiments, the medium consists of an acid in combination with a salt. In a preferred embodiment, the medium is >95% sulfuric acid.

Electrochemical Cell

As the electrochemical oxidation occurs, for example, in acidic medium, the vessel used to create the electrochemical cell must be inert to corrosive materials, high temperature (such as >100° C.) and high pressures (>500 psi). One such material is stainless steel. Other suitable materials include, but are not limited to, Alloy 230 (e.g., Haynes 230), Alloy 400 (e.g., Monel 400), Alloy 600 (e.g., Inconel 600), Alloy 625 Grl (e.g., Inconel 600 Grl), Alloy A-286 (e.g., Alloy 286), Alloy B-2/B-3 (e.g., Hastelloy B-2/B-3), Alloy C-276 (e.g., Hastelloy C-276), Nickel 200, Titanium Grade 2, 3, 4 and 7, Ziconium Grade 702 and 705, Incoloy, and Tantaline coated material. In some embodiments, the electrochemical cell is glass-lined. In some embodiments, the anode and the cathode are present in separate chambers of the electrochemical cell. In some embodiments, the separate chambers are in ionic communication with each other. In some embodiments, the oxidant is only present in the cathodic chamber. In other embodiments, the anode and the cathode are present in a single chamber in the electrochemical cell. In some embodiments, the electrochemical cell has a continuous flow of reactant, such as methane.

In certain embodiments, the electrochemical cell further comprises a reference electrode. In a preferred embodiment, the reference electrode is a platinum wire pseudoreference electrode. The reference electrode allows for measurement of the voltage of the reaction, indicating how much electrical energy is required for the reaction to proceed.

In some embodiments, the reaction conditions include a fluorine-doped tin oxide working electrode, a platinum wire pseudoreference electrode and a platinum mesh counter electrode in a fritted compartment. The cell resistivity can be about 20 ohms. The pseudoreference electrode can display a potential 0.5 V positive of a standard RHE electrode.

In certain embodiments, the electrical current is applied at a voltage of >1 V as measured between the anode and the reference electrode. In some embodiments, the electrochemical cell has a Faradaic efficiency greater than or equal to about 80%. In some embodiments, the electrochemical cell has a Faradaic efficiency greater than or equal to about 80%, such as greater than or equal to about 70%, such as greater than or equal to about 60%, such as greater than or equal to about 50%, such as greater than or equal to about 40%, further such as greater than or equal to about 30%.

In certain embodiments, the mixture is at a temperature greater than or equal to 150° C.; methanol and acetic acid are produced; and the electrical current is applied at a voltage of >0.5 V as measured between the anode and the reference electrode.

Cathode/Anode

In certain embodiments, exemplary cathode materials include, but are not limited to, platinum, palladium, gold, nitrogen-doped carbon, silver, iridium, rhodium, rhenium, rhenium sulfide, ruthenium, ruthenium sulfide, osmium, manganese oxide, lead oxide, and tungsten oxide. In a preferred embodiment, the cathode comprises platinum, such as platinum mesh.

In certain embodiments, the anode is selected from the group consisting of fluorine-doped tin oxide, indium-doped tin oxide, boron-doped diamond, gold foil or palladium foil. In certain embodiments, the anode is fluorine-doped tin oxide or boron-doped diamond. In a preferred embodiment, the anode is fluorine-doped tin oxide. In another embodiment, the anode is boron-doped diamond. In one embodiment, the anode is gold foil. In another embodiment, the anode is palladium foil.

Reaction Conditions

In certain embodiments, the mixture is at a temperature from about 20° C. to about 500° C., such as from about 70° C. to about 100° C., such as from about 150° C. to about 200° C., further such as from about 120° C. to about 140° C.

In certain embodiments, the pressure in the electrochemical cell ranges from about 1 psi to about 3,000 psi, such as about 100 psi to about 500 psi, about 200 psi to about 600 psi, about 200 psi to about 600 psi, about 250 psi to about 750 psi, or about 50 to about 400 psi.

Reaction Products

In certain embodiments, the reaction product comprises a C—O bond. In other embodiments, the reaction product comprises a C—S bond. In some embodiments, more than one product is formed which includes at least one compound with a C—O bond. In one embodiment, the products include MeOH, $MeOSO_3^-$ and $MeOSO_3H$. In other embodiments, more than one product is formed which includes at least one compound with a C—S bond. In one embodiment, the compound with a C—S bond is $MeSO_3H$.

Figure 4:
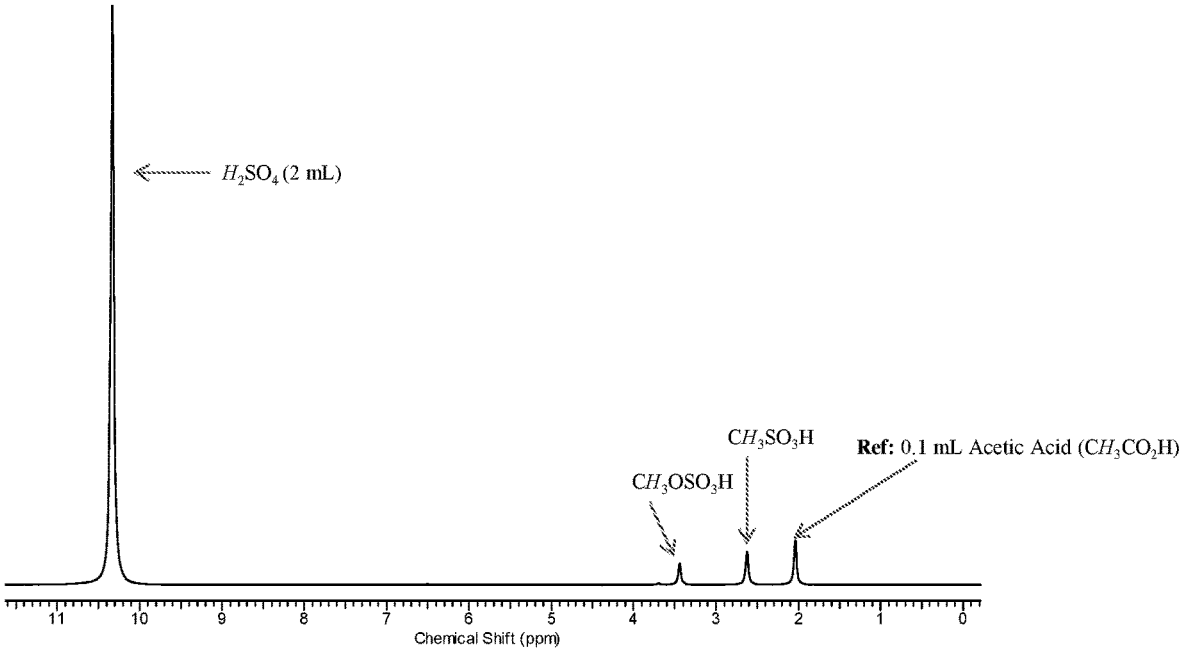
FIG. 4 depicts a $^1H$ NMR spectrum of the product mixture after electrochemical oxidation of methane to methanol using a $PdSO_4$ catalyst in the presence of $O_2$ in $H_2SO_4$. The methanol is produce in the form of its ester derivative $MeOSO_3H$. Also produced is $MeSO_3H$ that corresponds to the carbon-sulfur functionalization reaction. $MeSO_3H$ and $MeOSO_3H$ can be converted to methanol upon hydrolysis and thermolysis.

In certain embodiments, more than one product is formed, which includes MeOH, $MeOSO_3H$, and $MeSO_3H$. In certain embodiments, more than one product is formed, which includes $MeOSO_3H$ and $MeSO_3H$. See FIG. 4 for a $^1H$ NMR spectrum of a methane oxidation forming these products. In some embodiments, $MeOSO_3H$ is hydrolyzed to form MeOH. In certain embodiments, the MeOH product is isolated from the reaction mixture by dilution with equivolume $H_2O$, followed by extraction with chloroform, with the percent extraction of MeOH in the range of about 30-70%. See, Adv. Synth. Catal., 2005, 347, 1203-1206.

Unless otherwise indicated, all numbers expressing quantities of ingredients, properties such as molecular weight, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

It is to be understood that wherever values and ranges are provided herein, all values and ranges encompassed by these values and ranges, are meant to be encompassed within the scope of the present invention. Moreover, all values that fall within these ranges, as well as the upper or lower limits of a range of values, are also contemplated by the present application.

Examples

Those skilled in the art will recognize, or be able to ascertain using no more than routine experimentation, numerous equivalents to the specific procedures, embodiments, claims, and examples described herein. Such equivalents were considered to be within the scope of this invention and covered by the claims appended hereto. For example, it should be understood, that modifications in reaction conditions, including but not limited to reaction times, reaction size/volume, applied potential and experimental reagents, such as solvents, catalysts, pressures, atmospheric conditions, e.g., nitrogen atmosphere, and reducing/oxidizing agents, with art-recognized alternatives and using no more than routine experimentation, are within the scope of the present application.

The following examples are put forth so as to provide those of ordinary skill in the art with a complete disclosure and description of how to make and use the compounds and methods of the invention, and are not intended to limit the scope of what the inventor(s) regard(s) as the invention.

The recitation of a listing of elements in any definition of a variable herein includes definitions of that variable as any single element or combination (or subcombination) of listed elements. The recitation of an embodiment herein includes that embodiment as any single embodiment or in combination with any other embodiments or portions thereof.

Unless noted otherwise, the starting materials for the synthesis described herein were obtained from commercial sources or known synthetic procedures and were used without further purification.

Electrochemical Oxidation of Methane

Materials

High surface area platinum mesh, platinum wire (99.997%), and 20% $SO_3$ fuming sulfuric acid were obtained from Alfa Aesar. 2.2 mm Fluorine-Doped Tin Oxide coated glass slide with surface resistivity of 7 Ω/sq and tungsten wire were acquired from Sigma Aldrich. Palladium(II) sulfate dihydrate was acquired from Strem Chemicals. Concentrated hydrochloric acid (ACS reagent grade), concentrated nitric acid (68-70%, ACS grade), and concentrated sulfuric acid (ACS grade) were purchased from EMD Millipore. NMR solvents were obtained from both Cambridge Isotope Laboratories and Sigma-Aldrich. All reagents were used as received without further purification. Methane (UHP GR 4.0) and Ethane (UHP GR 5.0) were purchased from Airgas. 100 mL Parr reactor Model No. 4793 General Purpose Vessel constructed of T316 stainless steel was adapted with a Conax Technology Gland {TG-24T(KN)-A4-G}.

Electrochemical Methods

Unless otherwise noted, all electrochemical measurements were performed at ambient temperature (21±1° C.) using a Biologic VSP 16-channel or Gamry REF 600 potentiostat and a three-electrode electrochemical cell with a porous glass frit separating the counter from the working and reference electrodes. Prior to use, electrochemical cells were soaked in aqua regia overnight, rinsed with Millipore water (Millipore Type 1, 18 MΩ-cm resistivity), and dried in an oven at 120° C. for a minimum of 1 h. All measurements were conducted using a Pt-wire pseudoreference and reference to the potential of the Pt wire. Uncompensated resistance was maintained between 10 and 30 ohms.

Preparing the High Pressure Electrochemical Cell

Figure 2:
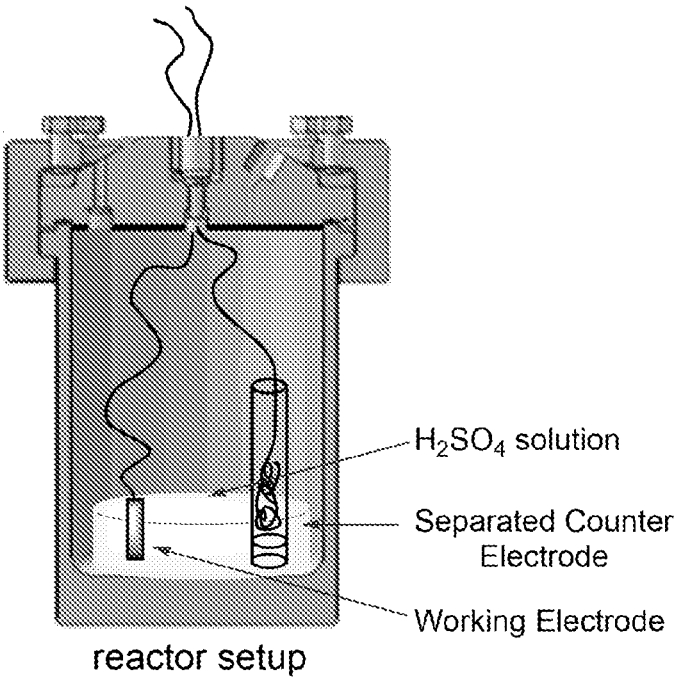
FIG. 2 depicts an exemplary electrochemical cell and a schematic of the inner design.

FIG. 2 depicts the construction of the High Pressure Electrochemical Cell. All electrochemical measurements were performed using a Biologic VSP 16-channel potentiostat and a three-electrode electrochemical cell with a porous glass frit separating the counter from the working and reference electrodes. The working electrode (WE) was cut into a 1×2.5 cm rectangle. Tungsten wire was wrapped tightly around the upper half ensuring resistivity between the WE and wire was below 25Ω. Next Teflon tape was wrapped around in the tungsten wire and the FTO plate leaving 1×1 cm of FTO plate exposed. The WE was placed in a furnace at 340° C. for at least 1 h to effectively melt the Teflon around the electrode. The platinum wire pseudo-reference and platinum mesh counter electrode were threaded and pressed with the gland-wires, then wrapped in Teflon tape and melted to form a seal (this was most effectively done by heating a glass pipette with a Bunsen burner with the electrode inside). Their respective resistivity was maintained below 2Ω. The working electrode was connected to the gland wire and wrapped with Teflon tape. FIG. 2 right depicts the setup inside the reactor. On top, a Teflon® cup with several holes at the bottom serves to hold the counter electrode compartment and wiring inside the reactor. Below is a glass liner/vial containing the reaction mixture. Once assembled, the platinum pseudo-reference was secured to outside of the fritted counter-compartment with Teflon tape.

Bulk Electrolysis Using Gold Foil in a High Pressure Electrochemical Cell

A sample of Au foil was weighed, and then attached to the tungsten wire that was placed in 13 mL of 98% sulfuric acid or 20% fuming sulfuric acid in a custom made glass liner, and then inserted into the high pressure electrochemical cell described above. The cell was pressured with 500 psi methane. The reactor was placed in a heated silicone oil bath maintained at 150° C. The chronoamperometry, with the current set between 10-50 mA, was initiated, causing the gold foil to electrooxidatively dissolve and form Au(III) species in solution. The total reaction time at the described temperature was 3 h. The reactors were then cooled, and slowly vented. MeOH conversion was determined by $^1$H NMR spectroscopy using acetic acid as an internal reference, and the final mass of the gold foil was measured. The data from these experiments is tabulated in Table 1.

TABLE 1

| $H_2SO_4$ type | Current (mA) | Electrolysis time (h) | Difference in Gold foil mass (g) | $Au^{III}$ electrogenerated (moles) | Charge Passed (C) | Electrons (moles) | MeOH (moles) |
|---|---|---|---|---|---|---|---|
| 20% Fuming | NA | NA | 0 | 0 | 0 | 0 | 0.000139 |
| 20% Fuming | 10-20 mA | 2 h | 0.08 | 0.000406 | 131.36 | 0.001364 | 0.00239 |
| 20% Fuming | 50 mA | 1 h | 0.1726 | 0.000876142 | 207.5 | 0.00215 | 0.00722 |
| 98% $H_2SO_4$ | 50 mA | 2 h | 0.220 | 0.001116 | 360 | 0.00373 | 0.005665 |

Bulk Electrolysis Using $PdSO_4$ in a High Pressure Electrochemical Cell $Pd(SO_4)(OH_2)_2$ (~0.005 g, $2.10\times10^{-5}$ mol) was dissolved in 2-4 mL of 20% fuming sulfuric acid in a custom made glass liner, and then inserted into the high pressure electrochemical cell described above. The cell was pressured with 500 psi methane. The reactor was placed in a heated silicone oil bath maintained at the described temperature. The chronoamperometry, with potential set between 1.1-1.8 V vs Pt-wire, was initiated, and intermittent CVs were acquired during analysis. CV experiments enable identification of any malfunction, such as those due to corrosion. The electrolysis at the described temperature was allowed to continue for >20 h. The reactors were then cooled, and slowly vented. MeOH conversion was determined by $^1$H NMR, using acetic acid as an internal reference.

Faradaic Efficiency of Bulk Electrolysis

Table 2 provides the parameters and results of this bulk electrolysis study. From the bulk electrolysis study of $PdSO_4$ in 20% fuming sulfuric acid conducted under 500 psi of $CH_4$ at 130° C. with no stirring, formation of methyl bisulfate and methanesulfonic acid as the products from electrolysis was confirmed using $^1$H NMR spectroscopy. A high concentration of methyl bisulfate in $H_2SO_4$ (0.5-1 M) was consistently observed. Running the electrolysis for 66 h, a 1 M concentration of MeOH was observed. The % FE is calculated for the two electron oxidation of methane to methyl bisulfate and the charge passed.

TABLE 2

| Voltage (V vs Pt-wire) | Time (hr) | Solvent Vol. (mL) | [Pd] (M) | Charge (Coulombs) | Methyl bisulfate (mmol) | Methyl sulfonic acid (mmol) | % FE |
|---|---|---|---|---|---|---|---|
| 0 | 22 | 2 | | 0 | 0 | 0 | — |
| 1.5 | 22 | 4 | $2.73\times10^{-2}$ | 648 | 1.84 | 0.79 | 54.9 |
| 1.5 | 22 | 2 | $9.60\times10^{-2}$ | 462.3 | 0.61 | 0.86 | 25.4 |
| 1.5 | 22 | 4 | $2.83\times10^{-2}$ | 431.6 | 1.25 | 0.57 | 55.7 |
| 1.5 | 22 | 4 | $3.70\times10^{-2}$ | 139.0 | 1.27 | 0.21 | 176.8 |
| 1.5 | 22 | 4 | $2.85\times10^{-2}$ | 215.6 | 1.15 | 0.69 | 103.3 |
| 1.3 | 22 | 4 | $2.78\times10^{-2}$ | 214.7 | 1.26 | 0.66 | 112.8 |
| 1.5 | 64 | 2 | $9.60\times10^{-2}$ | 462.3 | 0.79 | 1.12 | 33.2 |

Table 3 provides the parameters and results of a 5 h bulk electrolysis study to form methyl bisulfate and methane sulfonic acid. Both product concentrations and % FE were measured. The bulk electrolysis was run at 1.4 V using 9.2 mM $PdSO_4$ in 20% $SO_3/H_2SO_4$ (4 mL) with 500 psi $CH_4$ at 70° C. The % FE for the two electron oxidation of $CH_4$ to methyl bisulfate were calculated from the background subtracted methyl bisulfate values, obtained from the experiments with no current passed.

TABLE 3

| Stir rate/ rpm | Time (hr) | Solvent Vol. (mL) | [Pd] (M) | Charge (C) | Methyl bisulfate (mol) | Methyl sulfonic acid (mol) | Background subtracted MBS | % FE |
|---|---|---|---|---|---|---|---|---|
| 500 | 6 | 4 | $9.2 \times 10^{-2}$ | 0 | $9.44 \times 10^{-6}$ | 0 | — | — |
| 500 | 6 | 4 | $9.2 \times 10^{-2}$ | 10.245 | $3.25 \times 10^{-5}$ | $3.59 \times 10^{-4}$ | $2.31 \times 10^{-5}$ | 43.5 |
| 500 | 6 | 4 | $9.2 \times 10^{-2}$ | 11.360 | $3.67 \times 10^{-5}$ | $3.46 \times 10^{-4}$ | $2.72 \times 10^{-5}$ | 46.3 |
| 0 | 6 | 4 | $9.2 \times 10^{-2}$ | 0 | $1.05 \times 10^{-5}$ | 0 | — | — |
| 0 | 6 | 4 | $9.2 \times 10^{-2}$ | 2.375 | 0 | $2.52 \times 10^{-5}$ | 0 | 0 |
| 0 | 6 | 4 | $9.2 \times 10^{-2}$ | 2.037 | 0 | $1.89 \times 10^{-5}$ | 0 | 0 |

In other studies, in situ generation of $Pd_2^{III,III}$ at 70° C. in the presence of $CH_4$ generates $MeOSO_3H$ with a faradaic efficiency of ~47%, when the solution is agitated by stirring at ~500 rpm. Thus, in certain embodiments the overall faradaic efficiency for electrochemical methane oxidation to $CH_3OSO_3H$ is influenced by mass transport phenomena, which can be optimized by cell configuration, stirring, or other conventional approaches to mixing the contents of the electrochemical cell.

INCORPORATION BY REFERENCE

All U.S. patents and U.S. and PCT published patent applications mentioned in this specification are herein incorporated by reference to the same extent as if each independent patent and publication was specifically and individually indicated to be incorporated by reference.

While the invention has been disclosed with reference to specific embodiments, it is apparent that other embodiments and variations of this invention may be devised by others skilled in the art without departing from the true spirit and scope of the invention. The appended claims are intended to be construed to include all such embodiments and equivalent variations.

We claim:

1. A method of oxidizing a carbon-hydrogen bond of a compound, comprising:

a) in an electrochemical cell comprising an anode and a cathode, combining a medium, the compound, an oxidant, and a transition metal catalyst, thereby forming a mixture;

wherein the compound is an aliphatic compound or an aromatic compound, the oxidant is $O_2$, $O_3$, $H_2O_2$, $Cl_2$, $Br_2$, $I_2$, $SO_3$, $H_2SO_4$, $(IO_4)^{-2}$, $(IO_3)^{-2}$, or $(C_6F_5)I(OC(O)CF_3)_2$, the medium is an acid, and the transition metal catalyst is a palladium(II) ion; and b) applying an electrical current between the anode and the cathode, thereby forming a product in which the carbon-hydrogen bond has been converted to a carbon-oxygen bond or a carbon-sulfur bond;

wherein the cathode is in ionic communication with the mixture; and the anode is in contact with the mixture.

2. The method of claim 1, wherein the compound is an aliphatic compound; and the aliphatic compound is selected from the group consisting of an alkane, a heteroalkane, a cycloalkane, and a heterocycle.

3. The method of claim 2, wherein the aliphatic compound is a $C_{1-15}$ alkane.

4. The method of claim 3, wherein the $C_{1-15}$ alkane is selected from the group consisting of methane, ethane, propane, isopropane, butane, isobutane, pentane, isopentane, neopentane, hexane, heptane, and octane.

5. The method of claim 4, wherein the $C_{1-15}$ alkane is methane.

6. The method of claim 2, wherein the aliphatic compound is a $C_3$-$C_{15}$ cycloalkane.

7. The method of claim 6, wherein the $C_3$-$C_{15}$ cycloalkane is selected from the group consisting of cyclopropane, cyclobutane, cyclopentane, cyclohexane, decalin, and adamantane.

8. The method of claim 1, wherein the compound is an aliphatic compound; and the aliphatic compound is a heteroalkane comprising 1 to 3 atoms selected from the group consisting of N, O, and S.

9. The method of claim 1, wherein the compound is an aliphatic compound; and the aliphatic compound is a heterocycle comprising 1 to 3 heteroatoms selected from the group consisting of N, O, and S.

10. The method of claim 1, wherein the compound is an aromatic compound; and the aromatic compound is an arene or heteroarene.

11. The method of claim 1, wherein the aliphatic compound is an aliphatic compound represented by formula I:

I

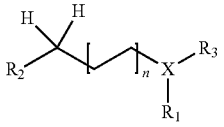

wherein

X is selected from the group consisting of CH, O, N, and S;

$R_2$ is selected from the group consisting of hydrogen, alkyl, and aryl;

$R_3$ is alkyl or aryl; and n is 1, 2, 3, 4, or 5; provided that:

if X is CH, then $R_1$ is selected from the group consisting of alkoxy, hydroxyl, halo, —C(O)-alkyl, and —C(O)OH;

if X is N, then $R_1$ is hydrogen or alkyl; or if X is O or S, then $R_1$ is absent.

12. The method of claim 1, wherein the oxidant is 02.

13. The method of claim 1, wherein the electrochemical cell anode and the cathode are present in separate chambers in the electrochemical cell; and the separate chambers are in ionic communication with each other.

14. The method of claim 1, wherein the anode is selected from the group consisting of fluorine-doped tin oxide, indium-doped tin oxide, and boron-doped diamond.

15. The method of claim 1, wherein the cathode is selected from the group consisting of platinum, palladium, gold, nitrogen-doped carbon, silver, iridium, rhodium, rhenium, rhenium sulfide, ruthenium, ruthenium sulfide, osmium, manganese oxide, lead oxide, and tungsten oxide.

16. The method of claim 1, wherein the acid is selected from the group consisting of methanesulfonic acid, phosphoric acid, hydrofluoric acid, hydrochloric acid, hydrobromic acid, hydroiodic acid, oxalic acid, tosylic acid, perchloric acid, nitric acid, acetic acid, trifluoroacetic acid, sulfuric acid, >95% sulfuric acid, and mixtures of $SO_3$ and sulfuric acid.

17. The method of claim 1, wherein the aliphatic compound is methane; and the product is methanol, methanesulfonic acid, or methyl sulfate.

18. The method of claim 17, wherein the product is methanol.

19. The method of claim 18, wherein the oxidant is 02.

20. The method of claim 1, wherein the anode comprises fluorine-doped tin oxide, indium-doped tin oxide, boron-doped diamond, gold foil or palladium foil; the acid is $H_2SO_4$, $CH_3SO_3H$, $CF_3CO_2H$, HF, HCl, HBr, HI, or any mixture thereof; and the cathode comprises platinum.

* * * * *